US009359838B2

(12) United States Patent
Bull

(10) Patent No.: US 9,359,838 B2
(45) Date of Patent: Jun. 7, 2016

(54) TWO-PIECE CONNECTION LIFT SYSTEM AND METHOD

(71) Applicant: Layton R. Bull, Houma, LA (US)

(72) Inventor: Layton R. Bull, Houma, LA (US)

(73) Assignee: VALLOUREC TUBE-ALLOY, LLC., Houston, TX (US)

( * ) Notice: Subject to any disclaimer, the term of this patent is extended or adjusted under 35 U.S.C. 154(b) by 497 days.

(21) Appl. No.: 13/841,060

(22) Filed: Mar. 15, 2013

(65) Prior Publication Data

US 2014/0262335 A1 Sep. 18, 2014

(51) Int. Cl.

| | |
|---|---|
| ***E21B 19/06*** | (2006.01) |
| ***E21B 19/02*** | (2006.01) |
| ***E21B 17/00*** | (2006.01) |

(52) U.S. Cl.
CPC ..... *E21B 19/02* (2013.01); *E21B 17/00* (2013.01)

(58) Field of Classification Search
USPC ..... 166/379, 85.1; 294/86.24, 86.25
See application file for complete search history.

(56) References Cited

U.S. PATENT DOCUMENTS

| | | | |
|---|---|---|---|
| 3,149,391 | A | 9/1964 | Boster |
| 4,798,404 | A | 1/1989 | Iyanicki |
| 5,611,398 | A | 3/1997 | Duhn et al. |

OTHER PUBLICATIONS

International Search Report and Written Opinion issued Aug. 22, 2014 in PCT/US14/23865.

*Primary Examiner* — Taras P Bemko
(74) *Attorney, Agent, or Firm* — Oblon, McClelland, Maier & Neustadt, L.L.P.

(57) ABSTRACT

A connection lift system for handling oil and gas drilling tubular components includes a core component and a ring-shaped component. A range of ring-shaped components may be screwed onto the core component. The ring-shaped component may be configured based on the tubular component to be handled, and the core may be compatible with lifting equipment. A method for handling tubular components is also provided.

25 Claims, 7 Drawing Sheets

TWO-PIECE CONNECTION LIFT SYSTEM AND METHOD

BACKGROUND

The present invention relates to a connection lift used for drilling and completing hydrocarbon wells and landing heavy loads in a well. The term "drill string or landing string component" means any component with a substantially tubular shape intended to be connected to another component to constitute either a string for drilling or performing operations within a hydrocarbon well or a landing string for landing heavy loads in a well. A drill string or landing pipe component may have two extremities with tool joint portions, a male 'pin' connection and a female 'box' connection, both of which may be threaded to allow connection to another pipe component.

When a drill string or landing string is taken apart, removed, or connected, connection lifts are used to attach to an area on the drill string or landing string component being removed from, or connected to, the drill string or landing string, such that the drill string or landing string component is suspended above the borehole by the connection lift. Drill pipes may be lifted one component at a time, or multiples of more than one component may be pulled out, run in, and stored as a group. An elevator device may be used to supplement the connection lift to lift or lower an assembly comprising a tubular component and the connection lift.

A connection lift may be used to attach elevators to tubular components such as a drill pipe or drill collar. Connection lifts may be used on components in a drill string or landing string such as drill pipes, heavy weight drill pipes, drill collars, and the parts which connect drill pipes, heavy weight drill pipes, and landing pipes known as tool joints.

Connection lifts may clamp onto or screw onto a string component. In particular, the present invention relates to threaded connection lifts. A threaded connection lift may be a short section of tubular pipe with threads on one end to connect to string components being handled, and a nub or bail on the other end to connect to an elevator.

Conventionally a connection lift comprises a single integral part, adapted to a specific type or size of pipe. When creating a new borehole, a hole may be drilled to a large diameter and small depth, casing may be inserted and cemented into place, before a smaller diameter hole is drilled to a deeper depth, requiring a new size of drill bit, and a new size of casing to be installed. In other words, as the well may get concentrically smaller and deeper, changes in tool and tubular component sizes may be required.

For each type or size of component whether in the same string, or in a different string, a specific corresponding connection lift must be used. Use of a different connection lift for each application requires both storing and swapping of connection lifts on the rig, which increases material and operational costs. Changes in connection lifts to accommodate the components to be lifted or lowered are costly.

Connection lifts must bear the weight of the components they are lifting or lowering, and undergo high cyclic stresses. Depending on the application, connection lifts may therefore withstand a variety of loads, and may be manufactured from different materials.

Typically, conventional connection lifts present on a rig are supplemented by additional tools, specifically adapted to the application at hand. A tool change is required, and the elevator system to be adapted to different connection lifts and tubes, increasing operational costs and down time.

SUMMARY

A connection lift system for handling oil and gas drilling tubular components comprises a core component and a ring-shaped component, where a range of ring-shaped components may be screwed onto a core component, such that the ring-shape component may be selected based on the tubular component to be handled, and the core may be compatible with lifting equipment.

BRIEF DESCRIPTION OF THE DRAWINGS

The characteristics and advantages of an exemplary embodiment are set out in more detail in the following description, made with reference to the accompanying drawings.

DETAILED DESCRIPTION OF THE EXEMPLARY EMBODIMENTS

It is an object and feature of an exemplary embodiment described herein to provide a two-piece connection lift system for holding, lowering and lifting tubular components.

One advantage of an exemplary two piece connection lift described herein is the modular design of the two-piece connection lift, which yields an increase in versatility and provides a reduction in storage space and costs. Another advantage of the exemplary two piece connection lift described herein is an improvement in productivity. The exemplary two piece connection lift no longer requires a lifting tool change for each type of tubular component, and reduces operational costs. These and other objects, advantages, and features of the exemplary two piece connection lift described herein will be apparent to one skilled in the art from a consideration of this specification, including the attached drawings.

Figure 3:
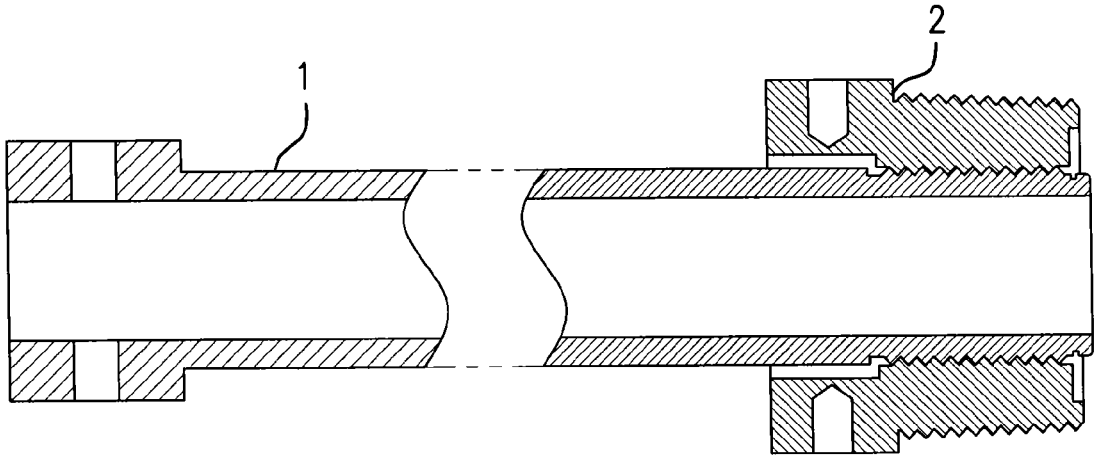
FIG. 3 depicts an exemplary embodiment.

Referring to FIG. 3, in an exemplary embodiment of the present invention, a two piece connection lift includes a core component (1), and a ring-shaped component (2), sometimes referred to as a donut component. One end of the core component may interface with the tubular component to be handled, the other end of the core component may interface with the ring-shaped component (2).

Core dimensions and properties may be set to match the plant or rig elevator equipment dimensions. Ring-shaped dimensions and properties may be set to match both the core dimensions on one end, and an application specific tubular component on the other end.

Figure 1A:
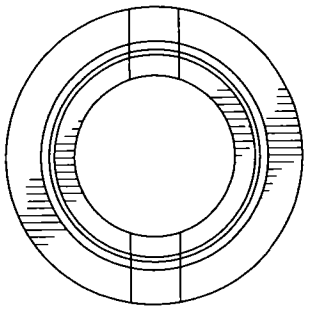
FIGS. 1A-1B depict schematic cross-sectional views of a first part of an exemplary embodiment.
Figure 1B:
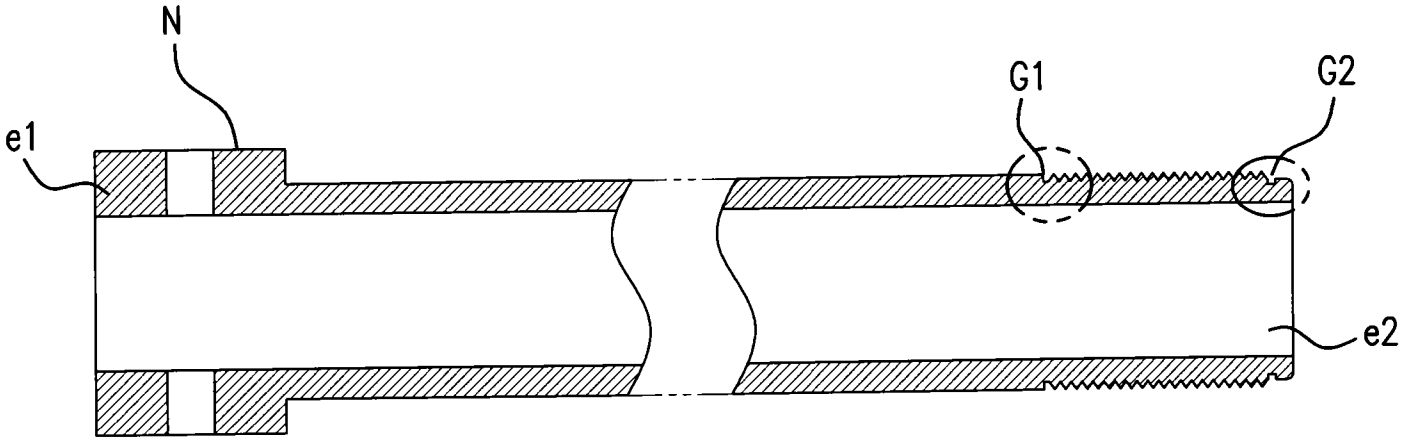

As shown in FIG. 1B, the core (1) is cylindrical in shape with a main portion, a first end (e1) and a second end (e2). A nub (N) is present at the first end, and the second end (e2) may be threaded. The nub (N) is characterized by an outer diameter which is larger than that of the core, and may have an axial length between 2.5" and 5" with an outer diameter between 1" to 2" larger than a core outer diameter. In a preferred embodiment, the nub outer diameter may be 6". In a preferred embodiment, the nub axial length may be 4". In an exemplary embodiment, the total axial length of the core component may be approximately 36". The presence of the nub allows the connection lift to be handled or interfaced with an elevator device. Two holes may be present in the nub, opposite to each other, and may be located 2" from the end of the tube. The core inner diameter may be between 3" and 3.5". In a preferred embodiment, the core inside diameter may be 3.250". In an exemplary embodiment, the core outer diameter may be between 3.5" and 6⅝", depending upon the size drill pipe with which this will interface. In a preferred embodiment, the core outer diameter may be 4.5".

The second end (e2) of the core may be threaded. In an exemplary embodiment, the threading may be a type 4.5-5 Acme thread. Acme threads may be characterized by their trapezoidal thread form, with a 29 degree flank.

A first groove (G1) may be present at one end of the second end (e2) threaded portion. A second groove (G2) may be present at the other end of the second end (e2) threaded portion.

Figure 2A:
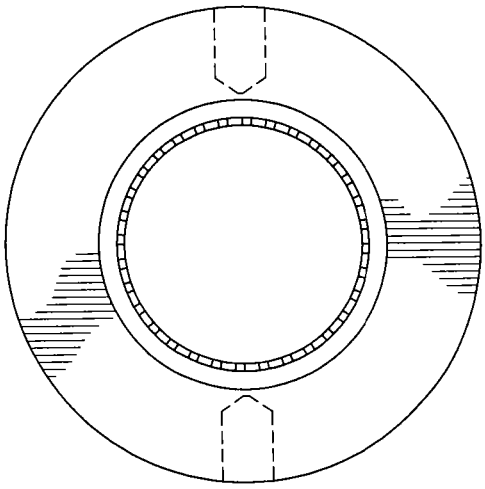
FIGS. 2A-2B depict schematic cross-sectional views of a second part of an exemplary embodiment.
Figure 2B:
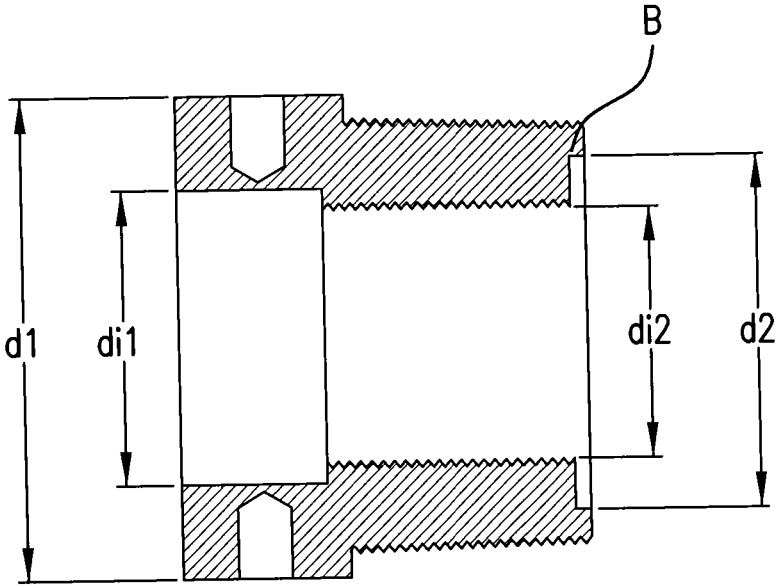

As shown in FIG. 2B, the ring-shaped component (2) may be cylindrical, with a first outer diameter (d1) and a second outer diameter (d2) and may extend over a total length between 7" and 8", with a pin end lift plug portion. The first outer diameter may be greater than the second outer diameter. In an exemplary embodiment the first outer diameter may extend over an axial length between 2.5" and 3.5". In a preferred embodiment the ring-shaped component may extend over a total axial length of 7.368". The ring-shaped component may also have a first inner diameter (di1) and a second inner diameter (di2). The ring-shaped component first inner diameter may be greater than the ring-shaped component second inner diameter. In an exemplary embodiment the ring-shaped component first inner diameter may be between 5.2" and 5.4", and extend over a length between 2.5" and 2.7". In a preferred embodiment the ring-shaped component first diameter may be 5.25". In a preferred embodiment the ring-shaped component first inner diameter may extend over a length of 2.618". In an exemplary embodiment the ring-shaped component second inner diameter may be threaded, for example with a 4.5-5 Acme internal thread over a length of 4.5". In an exemplary embodiment, the ring-shaped component second outer diameter may be threaded, for example with an Acme thread.

In an exemplary embodiment the ring-shaped component first outer diameter may be between 5.5" and 17.5", dependent upon the casing size with which the ring-shaped component will match, and extend over a length of 3". In an exemplary embodiment the ring-shaped component first outer diameter may be 8.614". In an exemplary embodiment the ring-shaped component second outer diameter may be between 4.5" and 16", dependent upon the casing size with which the ring-shaped component will match. In a preferred embodiment the ring-shaped component second outer diameter may be 6.614". Two holes may be drilled opposite to each other in the first outer diameter portion of the ring-shaped component, at a distance of 1.5" from the first outer diameter end of the ring-shaped component, with a diameter of 1.063" and a depth of 1.250". A bore (B) with depth between 0.240" and 0.260" for a diameter of 6.375" may be present at the end of the ring-shaped component threaded portion.

In an exemplary embodiment of the present invention both the core and ring-shaped component of the two-piece connection lift are sized such that the core connects with an elevator system on the rig, and the ring-shaped component connects to a specific casing size. In an exemplary embodiment of the present invention, the elevator used on the rig may be sized for a drill pipe. In an exemplary embodiment, the core may be inserted in the pre-sized elevator after the core element and ring-shaped element of the core and ring-shaped component connection lift system have been assembled. In an exemplary embodiment, after the core and ring-shaped component have been assembled, the ring-shaped component of the core and ring-shaped component assembly may be connected to the tubular component. In an exemplary embodiment, the core and ring-shaped component assembly may be connected to the elevator after the core and ring-shaped component assembly has been connected to the tubular component.

In an exemplary embodiment the ring-shaped component second outer diameter may be equal to the applicable casing outer diameter and thread form. Similarly, the core outer diameter may be equal to a drill string or landing string element outer diameter to match the respective elevator.

According to the above-noted sizing, in an exemplary embodiment of the present invention it is advantageously not required to re-size the elevator between use of a drill pipe and use of the two-piece connection lift system.

In an exemplary embodiment, the core outer diameter and ring-shaped component outer diameter may take values from the table below, which may be defined by a standard such as the API standard, depending on the application:

Two-piece core and ring-shaped component connection lift

| Core outer diameter (Drill pipe outer diameter) | Ring-shaped component outer diameter d2 (Casing outer diameter) |
|---|---|
| 3½ | 4½, 5, 5½, 6⅝ |
| 4½ | 6⅝, 7, 7⅝, 7¾, 8⅝, 9⅝ |
| 5½ | 7⅝, 7¾, 8⅝, 9⅝, 9⅞, 10¾, 11¾ |
| 6⅝ | 9⅝, 9⅞, 10¾, 11¾, 13⅜, 16 |

Figure 6B:
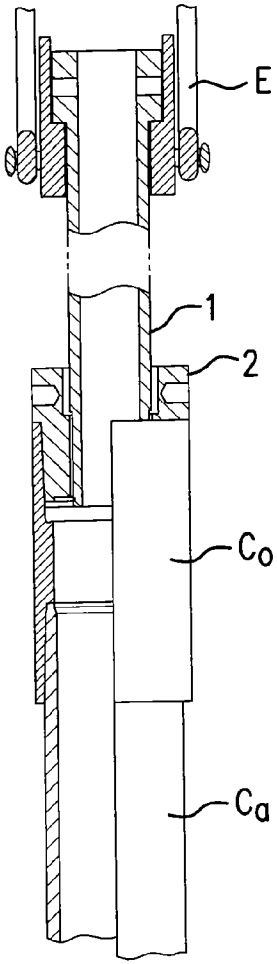
FIGS. 6A-6B depict an exemplary embodiment connected to a tubular component.
Figure 6A:
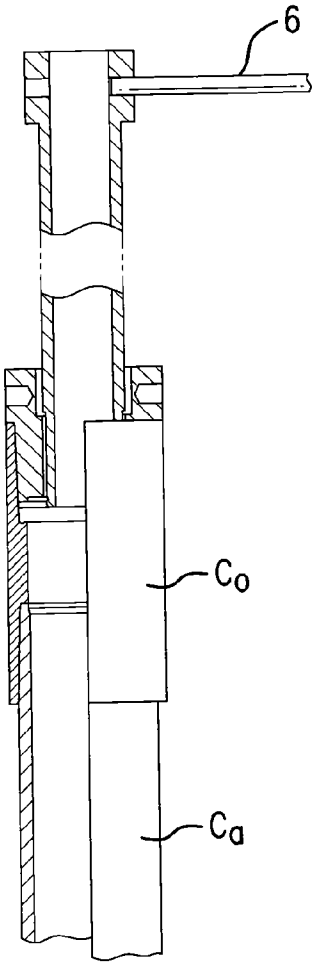

In an exemplary embodiment of the present invention the core and ring-shaped element connection lift, also referred to as a two-piece connection lift system, may be first assembled with the ring-shaped component selected for a particular application being screwed onto a core, and the core and ring-shaped component assembly may then be connected with a tubular component for which the ring-shaped component is adequately matched, as shown in FIG. 6A. Depending on the tubular component end geometry, the connection between the core component and the tubular component, for example a casing Ca, may be made by using a coupling member CO between the core component and the tubular component, as shown in FIG. 6A. In an exemplary embodiment where the end of the tubular component closest to the connection lift is a pin end, a coupling may be required to connect the tubular component pin end with the ring-shaped component. In another exemplary embodiment where the end of the tubular component closest to the connection lift is a box end, the tubular component may be directly connected, for example by screwing, to the ring-shaped component. Referring to FIG. 6B, the core component of the core and ring-shaped component assembly may then be connected to an elevator E or lifting system on the rig. In an exemplary embodiment of the present invention the nub of the core locks into an elevator which is part of a rig equipment, while the hollow coupling member CO is mated with the second outer diameter of the ring-shaped component, which may be threaded, as shown in FIG. 6B. The coupling member may further connect to a tubular component to be handled, such as a casing.

Figure 5:
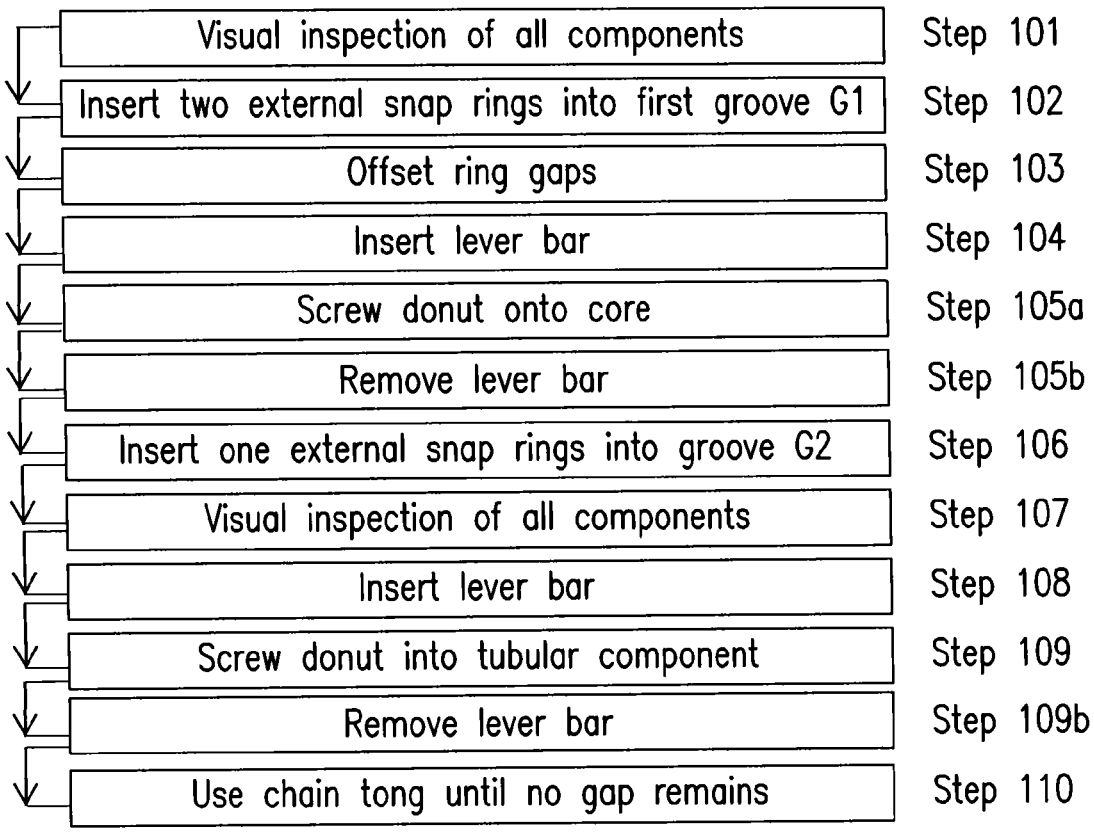
FIG. 5 depicts the steps to assemble the two-piece connection lift.

In an exemplary embodiment of the present invention and shown in FIG. 5, steps for use of the core and ring-shaped component connection lift system include a visual inspection of all components (Step 101) for defects, followed by a step of inserting two external snap rings into the first groove (G1) of the core (Step 102), with Step 103 to offset the ring gaps. A snap ring limits axial travel between the core and ring-shaped component. In an exemplary embodiment two rings may be used in groove G1 to both better fill the groove, which is designed for optimum relief of the threading tool during manufacturing, as well as to provide an additional safety during tightening operations. Indeed, in an exemplary embodiment, during tightening operations, the momentum of the thread may be greater than the momentum of the thread during loosening operations. Furthermore, once a core and ring assembly is complete, it may be difficult to perform a visual inspection of the area corresponding to groove G1, again warranting the use of two snap rings.

In an exemplary embodiment, ring gaps may be offset by approximately 90 to 180 degrees. The two external retaining rings may be installed onto the core in groove (G1) abutting threads, for example Acme threads, by using heavy-duty external snap ring pliers. In order to screw the core and ring-shaped component together, a large moment arm may be beneficial, and a cylindrical bar may be used for convenience.

Figure 4A:
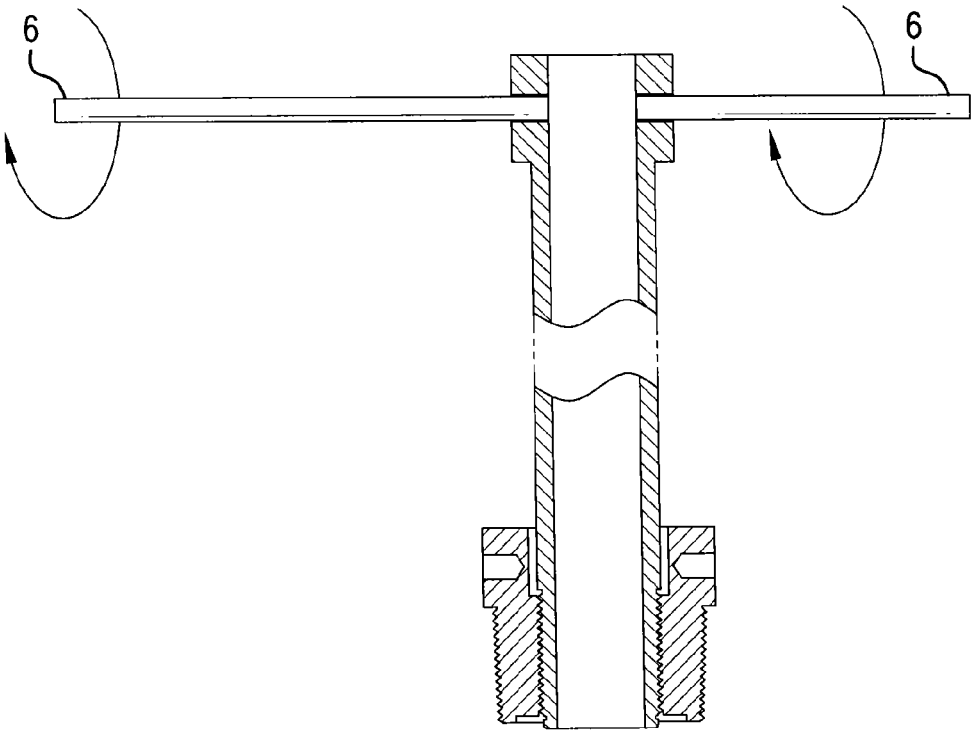
FIGS. 4A-4B depict the assembly of an exemplary embodiment.
Figure 4B:
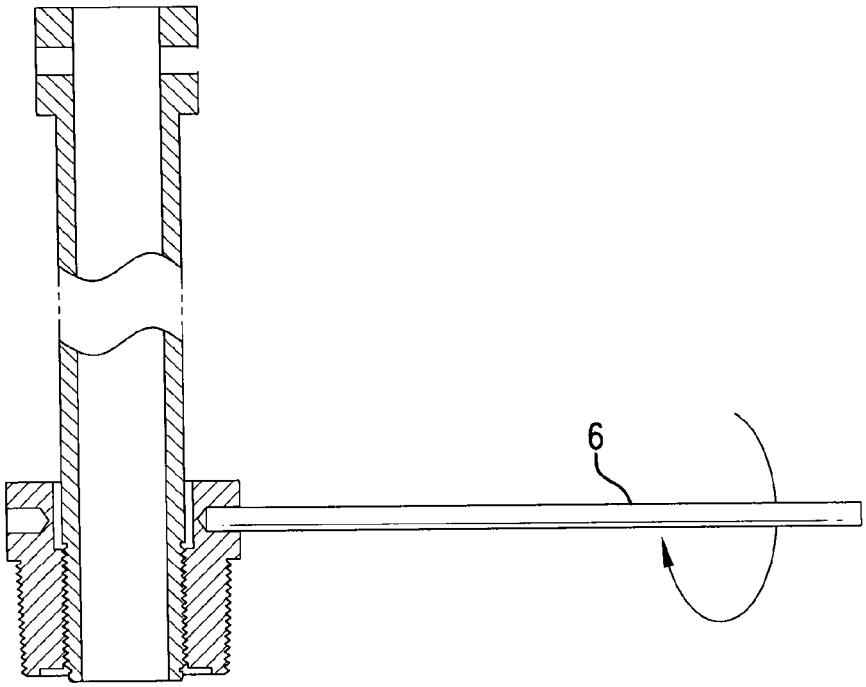

FIGS. 4A and 4B depict how a cylindrical bar (6) may be used as a lever to assemble the core and the ring-shaped component, and to mount the ring-shaped component of the core and ring assembly to a tubular component. In an exemplary embodiment the lever bar may be 1" in diameter, and may have a total nominal length of 2 feet. In an exemplary embodiment of the present invention, and as shown in FIGS. 4A and 4B, holes may be present in both core and ring-shaped component to accommodate the appropriate bar and to assist in thread tightening. In Step 104, the lever bar may be inserted into the appropriate holes in the core to screw the ring-shaped component onto the core component (Step 105). In an exemplary embodiment the lever bar may also help by providing a grip point for lifting and/or positioning of the core and ring assembly. The ring-shaped component may be screwed onto the core clockwise and running threads until the ring-shaped component is snug against the retaining rings.

In Step 106 an external snap ring may be inserted into the second groove (G2) of the core to fix the ring-shaped component into position. In an exemplary embodiment of the present invention, one snap ring may be sufficient in groove G2 to limit axial travel, and groove G2 may be visually inspected as needed. In an exemplary embodiment of the present invention, the retaining ring also referred to as snap ring may be inserted using heavy duty external snap ring pliers. In an exemplary embodiment, snap rings may be used as a stop point for the threads, which may be non interference free running threads. In other words, the snap rings may not be load bearing, but may simply limit travel.

Before operating the core and ring-shaped component connection lift, a visual inspection of the components may also be carried out. Accordingly, Step 107 may comprise a visual inspection of the assembled components.

The core and ring-shaped components may be connected to the tubular component being handled by aligning threads on the second outer diameter of the ring-shaped component with threads on the coupling member or on the box end of the tubular component being handled, and twisting. The twisting force to connect in this manner the core and ring assembly with the tubular component is applied at the level of the ring-shaped component.

Step 108*a* inserts a lever bar into one of the corresponding core holes to affix a tubular component from a landing or drilling string with the core and ring-shaped component connection lift. In Step 109 the lever bar may be used to aid screwing the core component of the core and ring assembly into the tubular component. In an exemplary embodiment, two lever bars may be used, one in each of the corresponding core holes, to provide a more uniform torque when threading the assembly into the tubular component. In Step 109*b* the lever bar is removed. Finally, Step 110 may use a chain tong to tighten the connection between the core and ring-shaped component lift and the tubular component until no gap remains. Power make-up may not be used for these operations.

Figure 7A:
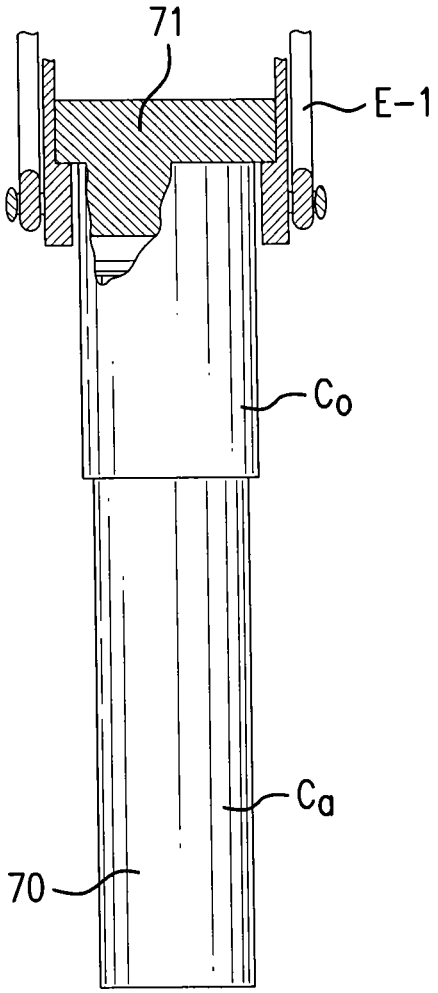
Fig.7A PRIOR ART
FIG. 7A depicts a schematic representation of an elevator to tubular component connection in the prior art.
Figure 7B:
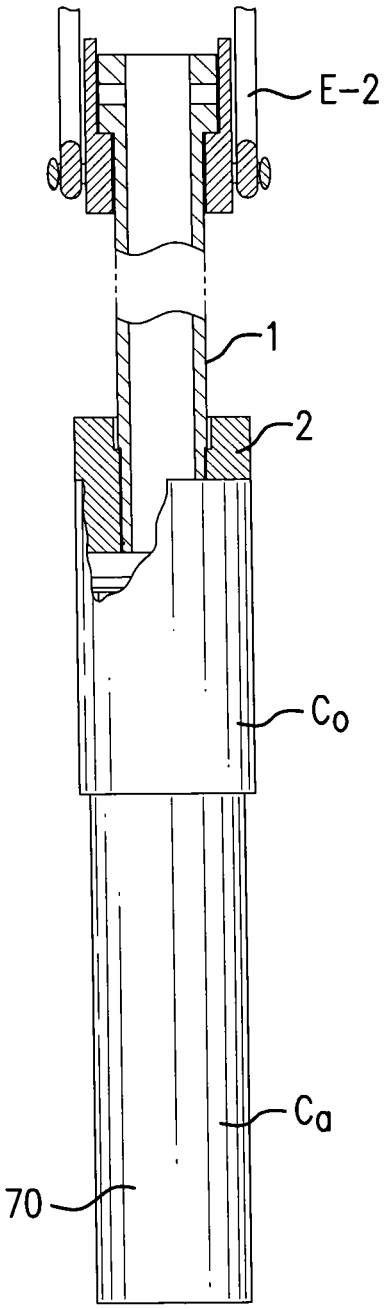
FIG. 7B is a schematic representation of an elevator to tubular component connection using an exemplary embodiment of the present invention.

Referring to FIGS. 7A and 7B, a side by side comparison may be made between the prior art described in FIG. 7A, and an exemplary embodiment of the present invention in FIG. 7B. As shown in FIG. 7A, a single lift plug component 71 may be used to lift the casing Ca, where a coupling member CO may be used. In this case, the elevator E1 sizing may be based on a casing dimension, requiring the elevator to be re-sized throughout the handling of the drilling string or landing string, or while performing completing operations. In contrast, as shown in FIG. 7B for an exemplary embodiment of the present invention, elevator E2 may be sized according to the drill pipe dimensions, and two distinct components, the core component 1 and ring-shaped component 2, may take the place of the single lift plug 71 in the prior art. In an exemplary embodiment of the present invention, pre-assembled core and ring-shaped component assemblies may be swapped out as needed during operations, without the need to resize the elevator. In an other exemplary embodiment, a single core may be disconnected and reconnected to a different ring-shaped component any time a lift system size change is required during the course of operations. Changeovers of different sized cores and ring-shaped components need not be limited to point-of-use only, but may be accomplished at any prior time and place convenient to rig operations. Predetermined sizing and matching of core and ring-shaped components may be accomplished, for example, in accordance with the well design and drilling plans prior to actual rig set-up at the work site.

In an exemplary embodiment of the present invention, both the core and ring-shaped component may be made of high strength steel. In an exemplary embodiment of the present invention, both core and ring-shaped component may be made from chrome-moly steel, which is quenched and tempered steel. In an exemplary embodiment the lever bar may be made of steel, such as hot rolled A-36 Steel, or cold drawn 4140 steel.

In an exemplary embodiment of the present invention, the load bearing portion of the core and ring-shaped connection lift may be the threads, for example Acme threads, which may bear a load of up to 600,000 lbs.

In an exemplary embodiment of the present invention the connection lift may bear loads between 600 and 20,000 lbs and may be used for loads corresponding to up to three tubular components at a time, corresponding to loads between 600 lbs and 4800 lbs.

Because many possible embodiments may be made of the invention without departing from the scope thereof, it is to be understood that all matter herein set forth or shown in the accompanying drawings is to be interpreted as illustrative and not in a limiting sense.

The invention claimed is:

1. A connection lift system for oil and gas drilling, comprising:

a core component being cylindrical and including a first end and a second end, the core component including external threads, and the core component being configured to match rig equipment; and a ring-shaped component being cylindrical and including internal threads and external threads, said ring-shaped component being configured to match a tubular component to be moved, and the external threads of the ring-shaped component are configured to couple to internal threads of the tubular component or to threads of a coupling sleeve that is configured to couple to external threads the tubular component;

wherein the external threads of said core component are configured to couple to the internal threads of said ring-shaped component, and in addition, the external threads of said core component are further configured to couple to internal threads of at least another ring-shaped component differing from said ring-shaped component in size, material, or configuration.

2. The system as claimed in claim 1, wherein said core component is configured to couple to a plurality of ring-shaped components differing from each other in size.

3. The system as claimed in claim 2, further comprising said plurality of said ring-shaped components differing from each other in diameter.

4. The system as claimed in claim 1, wherein the second end of the core component comprises the external threads of the core component between a first groove and a second groove.

5. The system as claimed in claim 4, wherein at least one snap ring is in the first groove.

6. The system as claimed in claim 5, wherein two snap rings are in the first groove and abut each other, and the snap rings are offset by an angle between 90 and 180 degrees.

7. The system as claimed in claim 4, wherein at least one snap ring in the second groove abuts the external threads of the core component.

8. The system as claimed in claim 1, wherein the first end of the core component comprises a nub with an outer diameter greater than an outer diameter of the core component.

9. The system as claimed in claim 8, wherein the nub comprises holes.

10. The system as claimed in claim 9, further comprising a lever bar configured to fit in at least one hole to provide leverage to assemble the core component and the ring-shaped component.

11. The system as claimed in claim 1, wherein a nub of the core component includes a nub outer diameter between 1" and 2" larger than an outer diameter of the core component, and an axial length of the nub is between 2.5" and 5".

12. The system as claimed in claim 11, wherein the nub outer diameter is 6" and the axial length of the nub is 4".

13. The system as claimed in claim 1, wherein a core outer diameter is between 3.5" and 6⅝" and an inner diameter of the core is between 3" and 3.5".

14. The system as claimed in claim 1, wherein a core outer diameter is 4.5" and an inner diameter of the core is 3.250".

15. The system as claimed in claim 1, wherein an axial length of the core component is approximately 36".

16. The system as claimed in claim 1, wherein a second end of the ring-shaped component comprises the internal threads of the ring-shaped component.

17. The system as claimed in claim 1, wherein a first end of the ring-shaped component comprises a nub with an outer diameter greater than an outer diameter of the core component.

18. The system as claimed in claim 17, wherein the nub comprises holes.

19. The system as claimed in claim 18, wherein a lever bar is inserted in the holes to assemble the ring-shaped component of the connection lift system to the tubular component.

20. The system as claimed in claim 1, wherein a first outer diameter of the ring-shaped component is between 5.5" and 17.5", and a second outer diameter of the ring-shaped component is between 4.5" and 16".

21. The system as claimed in claim 1, wherein a first outer diameter of the ring-shaped component is 8.614" and a second outer diameter of the ring-shaped component is 6.614".

22. The system as claimed in claim 1, wherein a first inner diameter of the ring-shaped component is between 5.2" and 5.4".

23. The system as claimed in claim 1, wherein a first inner diameter of the ring-shaped component is 5.25".

24. The system as claimed in claim 1, wherein an axial length of the ring-shaped component is between 7" and 8".

25. The system as claimed in claim 1, wherein an axial length of the ring-shaped component is 7.368".

* * * * *